US006688062B2

(12) United States Patent
Choate

(10) Patent No.: US 6,688,062 B2
(45) Date of Patent: Feb. 10, 2004

(54) REBAR LOOP HORIZONTAL LIFELINE FALL ARREST SYSTEM

(76) Inventor: Gary E. Choate, 1675 Carr St., #101N, Lakewood, CO (US) 80215

( * ) Notice: Subject to any disclaimer, the term of this patent is extended or adjusted under 35 U.S.C. 154(b) by 0 days.

(21) Appl. No.: 09/974,567

(22) Filed: Oct. 9, 2001

(65) Prior Publication Data

US 2002/0040559 A1 Apr. 11, 2002

Related U.S. Application Data

(60) Provisional application No. 60/239,389, filed on Oct. 10, 2000.

(51) Int. Cl.[7] ..... A62B 35/00
(52) U.S. Cl. ..... 52/414; 52/DIG. 12; 182/3
(58) Field of Search ..... 52/414, DIG. 12; 182/3, 36

(56) References Cited

U.S. PATENT DOCUMENTS 5,029,670 A * 7/1991 Whitmer ..... 182/113
5,398,777 A * 3/1995 Ouellette et al. ..... 182/3
5,699,875 A * 12/1997 Dugan ..... 182/3
5,863,020 A * 1/1999 Olson et al. ..... 248/228.3
6,056,085 A * 5/2000 Cutter et al. ..... 182/36
6,502,663 B2 * 1/2003 Ecker et al. ..... 182/3

* cited by examiner

*Primary Examiner*—Carl D. Friedman
*Assistant Examiner*—Basil Katcheves
(74) *Attorney, Agent, or Firm*—Ramon L. Pizarro; Edwin H. Crabtree

(57) ABSTRACT

A receiver assembly for retaining a stanchion between a pair of looped supports. The receiver includes a support frame and a receiver support, the receiver support, the receiver support being adapted for engaging and retaining the stanchion. The receiver assembly also includes a locking bar that extendins from the support frame. The locking bar is adapted for engaging the pair of looped supports while extending between the pair of looped supports, so that the stanchion is retained in a generally upright position by the cooperation of the base and the locking bar with the looped supports.

7 Claims, 6 Drawing Sheets

REBAR LOOP HORIZONTAL LIFELINE FALL ARREST SYSTEM

REFERENCE TO RELATED APPLICATIONS

This application claims the benefit of my provisional application having Ser. No. 60/239,389, filed Oct. 10, 2000, now abandoned.

BACKGROUND OF THE INVENTION (a) Field of the Invention

The present invention relates to a method of establishing anchor stanchions on concrete bridge beams that can be anchored to the standard loop type rebar that protrudes from the top of concrete bridge beams.

Additionally this invention relates to a method to tie back the anchorage stanchions to increase their load carrying capability.

(b) Discussion of Known Art

Horizontal Lifeline systems are currently used for fall protection on many applications involving bridge building and other construction activities. Bridge beams currently have looped rebar protruding from the top of the prestressed beams that are used to provide attachment points for the decking that is laid over them. Workers that work atop these beams need fall protection while laying the decking. Currently horizontal lifelines are attached to this rebar, but the lifelines lay on top of the concrete beams. When attached to these lifelines a worker, using a six-foot shock absorbing lanyard will fall 12 feet before his lanyard begins to pull on the lifeline. The U.S. Occupational Safety and Health Administration (OSHA) requirements state that all fall protection systems must be rigged so that a worker may not experience more than six feet of free fall. For this reason there existed a need to develop a stanchion system that will raise the horizontal lifeline five feet above the walking/working surface. This five foot elevation is the same elevation as the Dorsal D-ring on the worker's harness. When using a six foot shock absorbing lanyard and a stanchion assembly that will support a horizontal lifeline (HLL) at least five feet above the walking/working surface the six foot freefall limitation required by OSHA will be met.

This present invention relates to a method of installing horizontal lifeline systems on looped rebar bridge beams with stanchions that will support the lifelines at least five feet above the top, (walking surface) of the bridge beam.

An example of a lifeline support that includes a stanchion can be found in U.S. Pat. No. 5,863,020, to Olson et al., incorporated herein by reference.

SUMMARY

It has been discovered that the problems left unanswered by known art can be solved by The present invention relates to an improved method of installing horizontal lifelines on stanchions to concrete bridge beams that contain looped rebar protrusions along their top. This invention provides for a method to install the stanchions and a method to cause the stanchions to lean left, right or stand centered to provide ease of access for the workers. This invention also provides a method to tie back the stanchions for additional support. It allows for lifelines that can support at least 7,500 lb. Of line tension with a 2 to 1 safety factor and can be used by up to 4 persons at one time. It provides end stanchions for anchorage of the horizontal lifelines and bypass stanchions which are used to shorten apparent span lengths to decrease free fall distances and horizontal lifeline sag height.

Thus, when using the disclosed system and method, the user will also carry out the following steps:

a. Providing an anchorage stanchion receiver that will attach to looped rebar.

b. Providing a HLL end stanchion that will attach to the stanchion receiver.

c. Providing a HLL bypass stanchion that will attach to the stanchion receiver.

d. Providing a tie back cable assembly that will attach the end stanchions to the looped rebar.

e. Providing a horizontal lifeline system that will attach to the end stanchions.

In another aspect this invention relates to a method to adjust the stanchion system from one side of the concrete bridge beam to the other side. This feature allows the worker to work on either side of the bridge beam and also allows the stanchion to be shifted out of the way when decking is being lowered into place over the bridge beams with a crane.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

FIGS. 1 through 5 illustrate the looped rebar stanchion and receiver assembly and installation according to the preferred embodiment of this invention.

Figure 1:
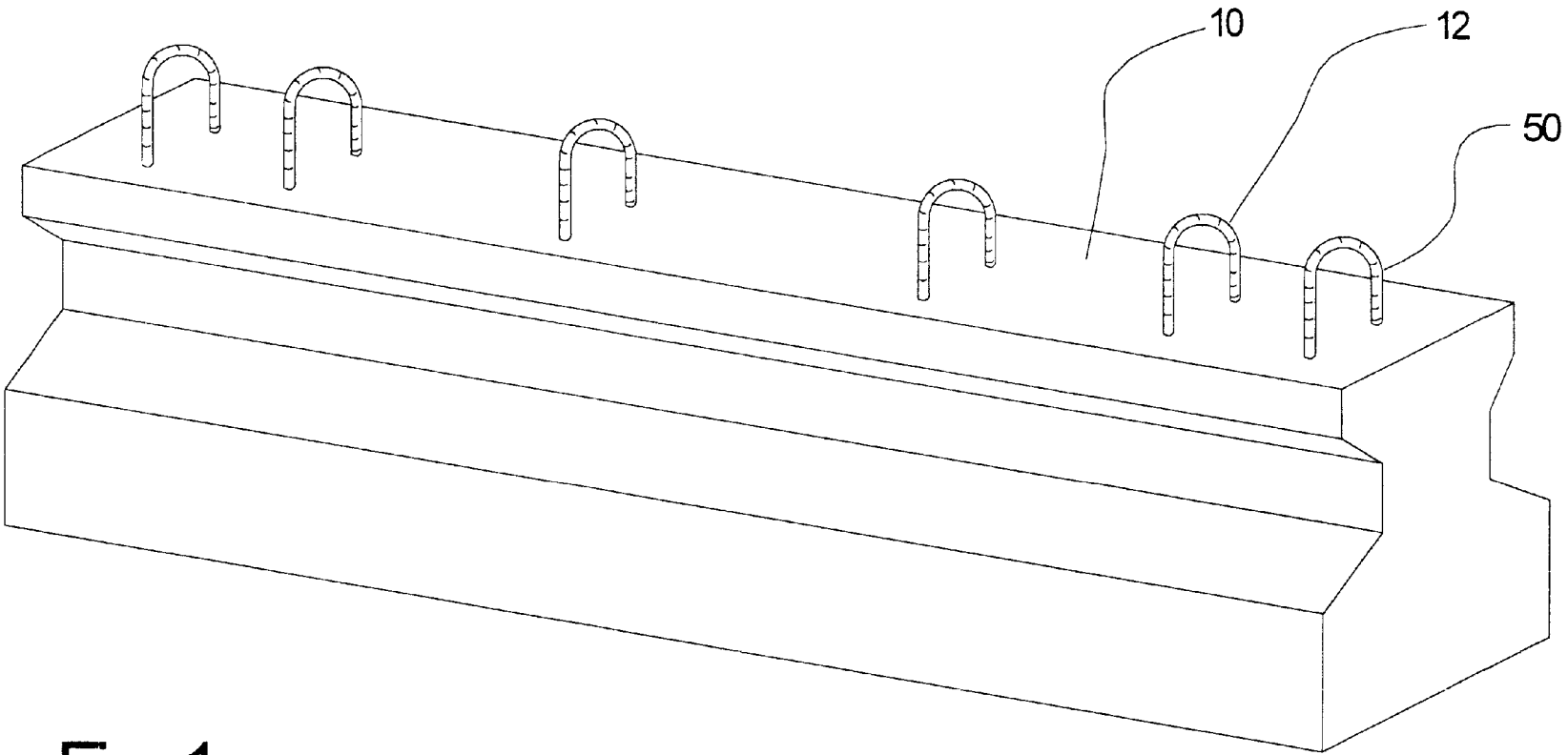
FIG. 1 is a detail of the concrete bridge beam with looped rebar.
Figure 2:
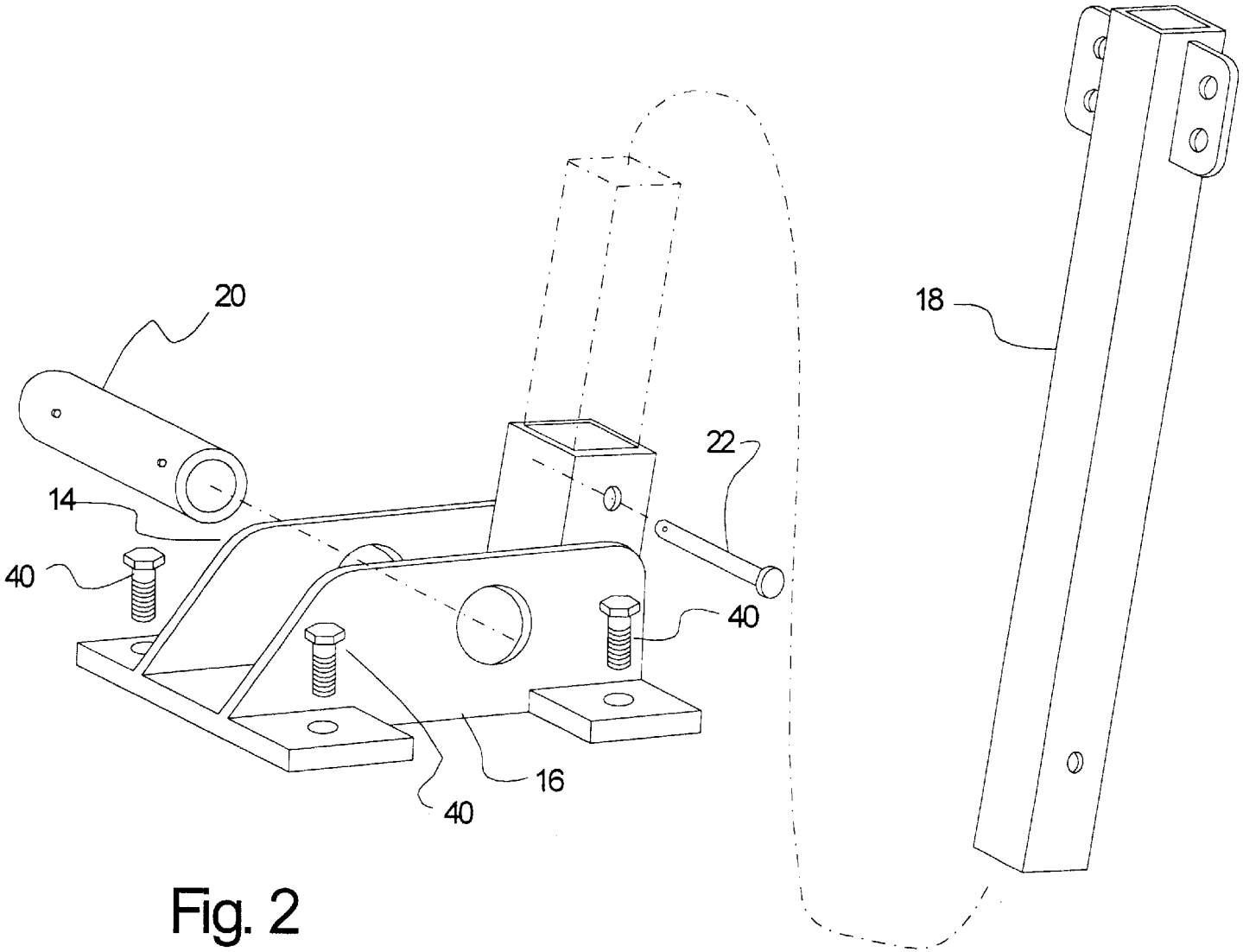
FIG. 2 is a detail of the fixed angle rebar loop end stanchion and receiver.

Referring to FIG. 1 the concrete bridge beam 10 is shown with the looped rebar 12 that projects from the top of the beam and that is used for attaching the decking to the concrete beam. The spacing of the looped rebar 12 may vary along the beam, the variations changing the loop width and height. A fixed angle looped rebar assembly 14 is shown in FIG. 2. This assembly consists of the receiver 16, the stanchion 18, the locking bar 20, the anchoring pin 22 and the adjusting screws 24.

Figure 3:
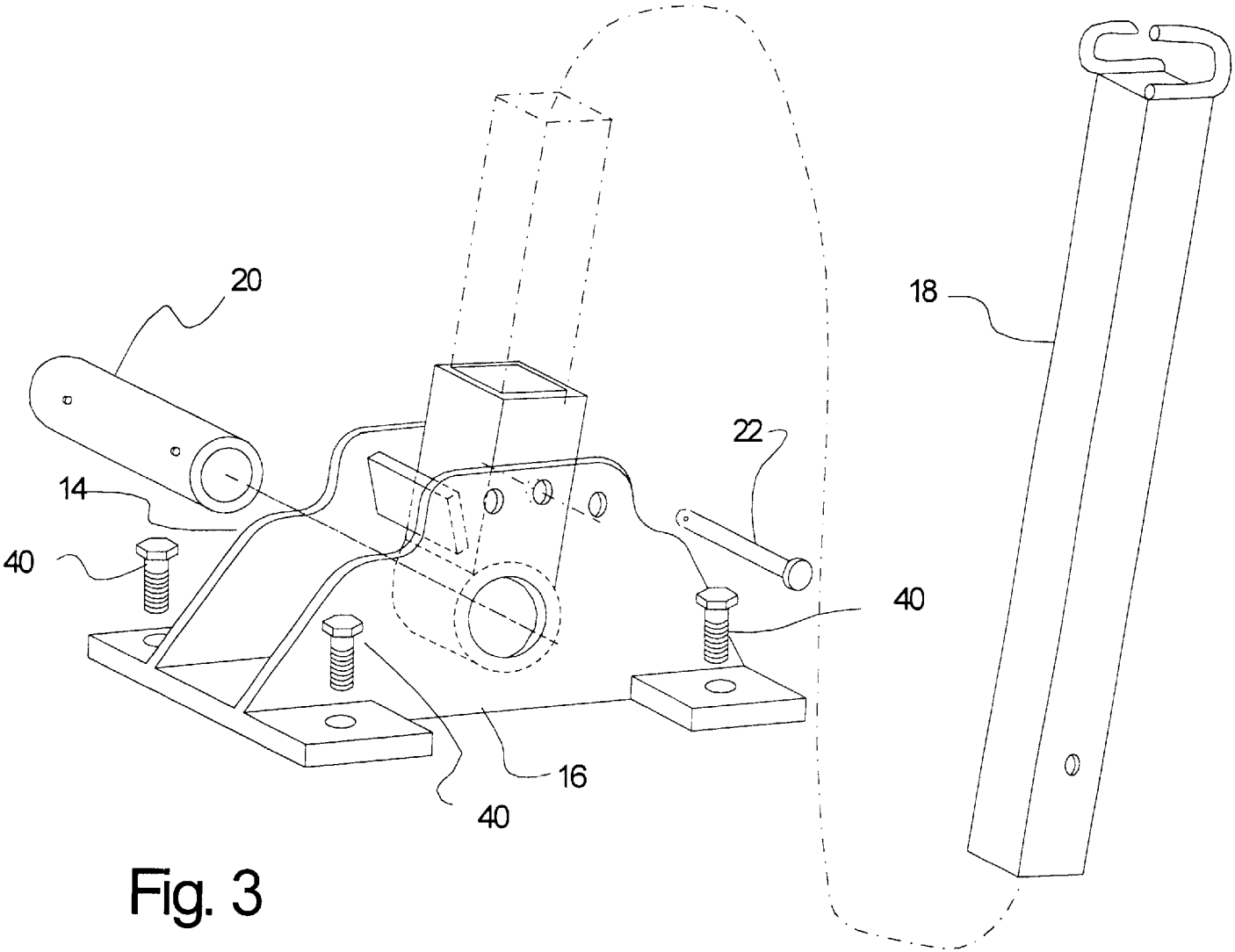
FIG. 3 is a detail of the pivotable rebar loop receiver with bypass assembly.
Figure 4:
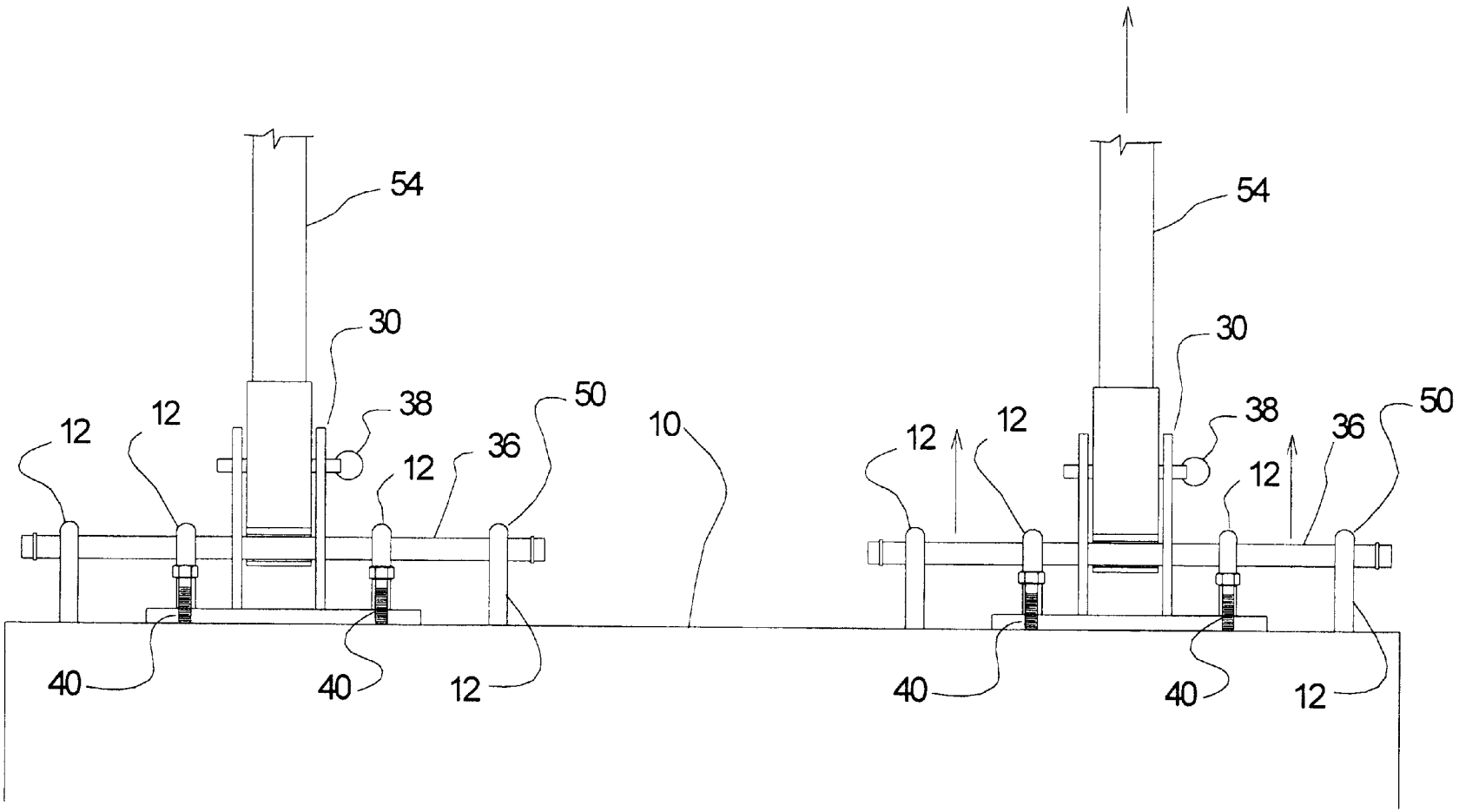
FIG. 4 is an elevation of the looped rebar receiver installation.
Figure 5:
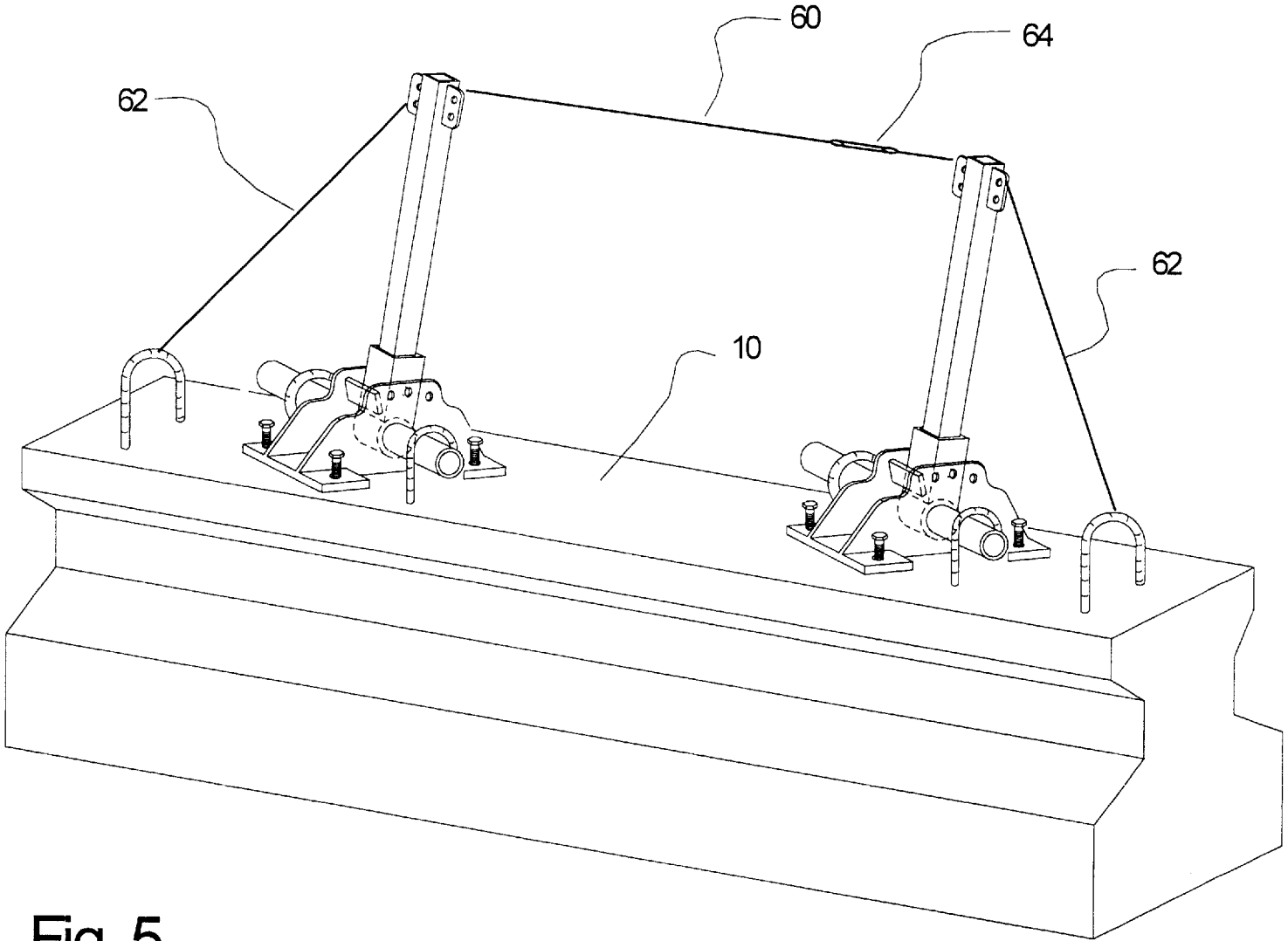
FIG. 5 is an isometric view of the looped rebar horizontal lifeline system.
Figure 6:
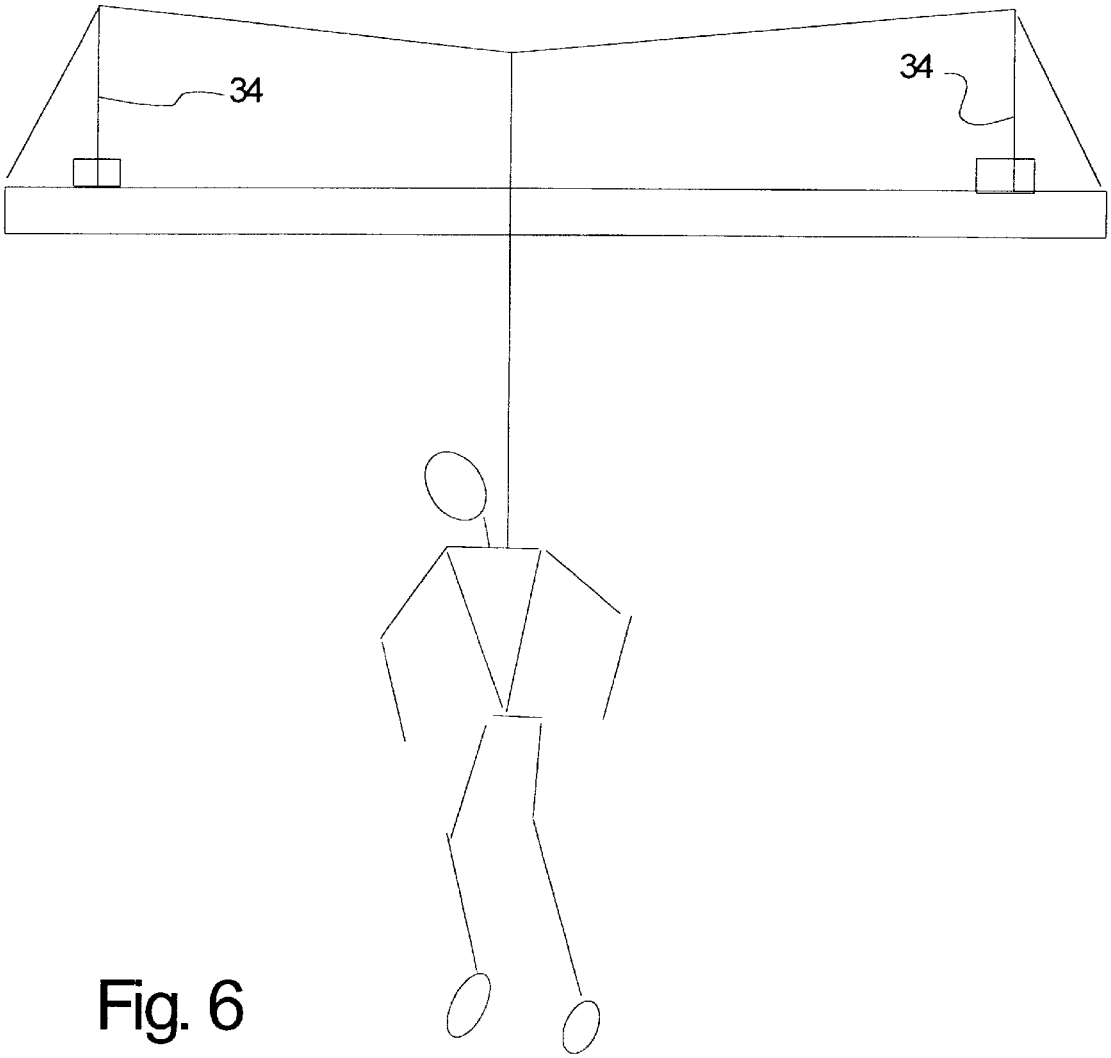
FIG. 6 illustrates use of the system.

FIG. 3 shows the pivotable rebar loop receiver and stanchion assembly 30. This assembly consist of the receiver 32, the stanchion 34, the locking bar 36, the anchoring pin 38 and the adjusting screws 40. The pivotable rebar loop receiver tube 46 can be adjusted from side to side using pin locations 42 and 44 or be mounted vertically using pin location 48. The receiver tube 46 is pivotable around the locking bar 36 after it is inserted through the rebar loops 12 and through the receiver hole 50. Referring to FIG. 4 the receiver and stanchion assembly 30 can be seen in elevation view in its locked and unlocked positions. In the left view the receiver assembly 30 has been placed over the rebar loops 12 with the loops 12 centered on the receiver hole 50. Once fully inserted and being located under several rebar, the receiver tube 46, is inserted into the receiver 30 and centered to carry the loads on as many rebar loops 12 as possible. The receiver 30 is then locked into place by adjusting the adjusting screws 40 until the top of the locking bar 30 rests snugly against the inside top of the rebar loops 50, the anchor pin 38 is then removed, the stanchion 34 inserted, and the anchor pin 38 then replaced in the receiver 30 at the hole 42, 44, or 48 that corresponds to the desired angle. The horizontal lifeline 60 (FIG. 5) is then installed with the tiebacks 62 and then the system is ready to use after the HLL cable 60 has been set to the proper tension as measured on the shock absorber 64.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A receiver assembly for retaining a stanchion between a pair of looped supports, the receiver comprising:

a support frame that is height adjustable;

a receiver support, the receiver support being attached to the support frame, the receiver support being adapted for engaging and retaining the stanchion; and a locking bar extending from the support frame, the locking bar being adapted for engaging the pair of looped supports while extending between the pair of looped supports, so that the frame together with the locking bar are urged against the looped supports by raising the frame, and so that the stanchion is retained in a generally upright position by the cooperation of the support frame and the locking bar with the looped supports.

2. A receiver assembly according to claim 1 wherein said frame includes a set of adjusting screws that serve for adjusting the height of the support frame.

3. A receiver assembly for retaining a stanchion between a pair of looped supports, the receiver comprising:

a support frame that is height adjustable;

a receiver support, the receiver support being attached to the support frame, the receiver support being adapted for engaging and retaining the stanchion; and a locking bar extending through the support frame, the locking bar being adapted for engaging the pair of looped supports while extending between the pair of looped supports, so that the frame together with the locking bar are urged against the looped supports by raising the frame, and so that the stanchion is retained in a generally upright position by the cooperation of the support frame and the locking bar with the looped supports.

4. A receiver assembly according to claim 3 wherein said frame includes a set of adjusting screws that serve for adjusting the height of the support frame.

5. A receiver assembly according to claim 3 wherein said support frame approximately bisects said locking bar.

6. A method for supporting a horizontal lifeline from a structure including at least two sections of looped rebar protruding from the structure, the method comprising:

providing a support frame having a receiver support, the receiver support being attached to the support frame, the receiver support being adapted for engaging and retaining the stanchion, the frame further having a locking bar, the locking bar extending from the support frame;

engaging the pair of looped supports by inserting the locking bar through the looped supports extending between the pair of looped supports; and raising the support frame to urge the locking bar against the looped supports, so that the frame together with the locking bar are urged against the looped supports by raising the frame, and so that the stanchion is retained in a generally upright position by the cooperation of the support frame and the locking bar with the looped supports.

7. A method according to claim 6 wherein said support frame includes a set of adjusting screws that serve for adjusting the height of the support frame so that the step of raising the support frame to urge the locking bar against the looped supports is carried out by turning the adjusting screws.

* * * * *